US006202559B1

(12) United States Patent
Sanford et al.

(10) Patent No.: US 6,202,559 B1
(45) Date of Patent: Mar. 20, 2001

(54) AIR-SAFED MECHANICAL WATER ACTUATOR

(75) Inventors: Matthew J. Sanford, Bel Alton, MD (US); Keith B. Lewis, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/156,382

(22) Filed: Sep. 18, 1998

(51) Int. Cl.[7] ..... F42B 22/00

(52) U.S. Cl. ..... 102/406; 102/416; 102/229; 102/48

(58) Field of Search ..... 102/223, 263, 102/390, 399, 406, 416, 239, 229, 423, 428, 429; 114/20.1, 238

(56) References Cited

U.S. PATENT DOCUMENTS 2,660,952 * 12/1953 Mohaupt ..... 102/204
3,765,331 * 10/1973 Montesi ..... 102/416
3,765,332 * 10/1973 Baker et al. ..... 102/416
4,100,855 * 7/1978 O'Callaghan ..... 102/48

* cited by examiner

*Primary Examiner*—Charles T. Jordan
*Assistant Examiner*—M. Thomson
(74) *Attorney, Agent, or Firm*—James B. Bechtel, Esq.; Peter J. Van Bergen, Esq.

(57) ABSTRACT

A mechanical device for generating actuating movement has a housing defining a first bore and a second bore contiguous therewith. The housing also defines radial ports that allow an environment about the housing to communicate with the first bore. A first piston is slidably mounted in the first bore. A second piston is slidably mounted in the second bore and is positioned so that it is flush with the first bore. A spring, coupled to the first piston, is capable of an at-rest state in which the first piston seals off the radial ports while being spaced apart from the second piston. The spring is also capable of a compressed state in which the first piston is positioned such that the radial ports communicate with the first bore between the first and second pistons. When the spring is released from its compressed state and allowed to transition to its at-rest state, the first piston moves to seal off the radial port(s) and subsequently pressurize any fluid in the first bore between the first piston and the second piston. If the fluid is incompressible (e.g., water), the pressurized fluid drives the second piston along the second bore to create the actuating movement.

23 Claims, 1 Drawing Sheet

AIR-SAFED MECHANICAL WATER ACTUATOR

CROSS-REFERENCE TO RELATED PATENT APPLICATIONS

This patent application is co-pending with one related patent application entitled "LOCK AND RELEASE MECHANISM" filed Dec. 15, 1998 as U.S. patent application Ser. No. 09/211,002, and owned by the same assignee as this patent application.

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to actuators that operate when submersed in a fluid environment, and more particularly to an air-safed mechanical actuator that operates in deep or shallow water (and/or cold water environments) only when the actuator is properly readied for operation and submersed in the fluid environment.

BACKGROUND OF THE INVENTION

Ordnance such as grenades, bombs, mines and torpedoes typically have an actuator in the form of a fuze or detonator which permits initiation of a main charge only when certain conditions are met. For example, if the ordnance is only supposed to detonate underwater, the fuze is designed to prevent in-air detonation. Several such fuzes are known in the prior art.

U.S. Pat. Nos. 3,765,331 (the '331 patent) and 3,765,332 (the '332 patent) disclose water-armed air-safetied detonators in which a plurality of small explosives are aligned in a spaced-apart fashion in a fuze housing. The first of these small explosives is a delay charge which ignites when the ordnance is launched or released. The delay charge eventually burns and flashes down an adjacent housing bore to ignite a transfer charge. Detonation of the transfer charge releases energy that is either used to move a piston (the '331 patent) or is in the form of a shock wave (the '332 patent). This released energy is delivered to a chamber that is flooded with either air or water depending on the environment in which the fuze is immersed. Adjacent the flooded chamber is a firing pin/percussion primer (the '331 patent) or just a percussion primer (the '332 patent). If the flooded chamber is filled with air, the released energy in the form of a moving piston (the '331 patent) or shock wave (the '332 patent) will not transfer through to the next stage of the fuze. If, however, the fuze is submerged in water, the flooded chamber is filled with water and the released energy entering the flooded chamber is transferred therethrough to the next stage of the fuze.

Although being air-safed, these devices still have several disadvantages. The use of explosives as part of the fuze train can be inherently problematic. These problems range from the safety concerns related to the construction and storage of such devices to the fact that these fuzes are not reusable. In general, use of stored energy for arming and firing is considered bad design practice because the energy is available at all times during storage and transportation, and may therefore be released due to unforeseen causes or situations.

Further, the use of explosives eliminates these devices from consideration as an all-purpose actuator that is water-armed and air-safed.

To overcome the problems inherent with the use of explosives, a mechanical underwater firing mechanism is disclosed in U.S. Pat. No. 2,660,952. Briefly, a spring-loaded plunger is mounted in a housing. The head of the plunger is formed with a recess. Fitted in the housing coaxial with the plunger is a plug having a central bored portion in which a firing pin is temporarily positioned intermediately therein by a shear pin. As a result, small chambers are defined in the central bored portion on either side of the firing pin. The central bored portion of the plug opposes the plunger's recess and is sized at its exterior to fit within the recess. When the spring-loaded plunger is cocked, the head of the plunger is spaced apart from the central bored portion of the plug to define a chamber within the housing. An opening in the side of the housing at the chamber allows the environment surrounding the housing (e.g., air or water) to fill the chamber.

When the spring-loaded plunger is released, the plunger recess envelops the central bored portion of the plug to compress any fluid trapped in the small chamber of the central bored portion between the firing pin and the head of the plunger. If the trapped fluid is air, the compression thereof will not develop forces sufficient to cause the firing pin's shear pin to fail. However, if the trapped fluid is water, the compression forces imparted by the plunger will be sufficient to cause failure of the firing pin's shear pin thereby allowing movement of the firing pin to impact a primer.

While eliminating the use of explosives in the firing mechanism, this device has other disadvantages. For example, the requirement that a small chamber be defined in the central bored portion opposing the head of the plunger raises the possibility that an air bubble will form therein when the device is submerged in water. The presence of such an air bubble could prevent the mechanism from functioning underwater. At the same time, the requirement that the small chamber be present in the central bored portion could also bring about an unwanted firing. This could occur if the mechanism were not cocked and inadvertently dropped in water. Water could seep into the mechanism and fill the small chamber. Then, an in-air release of the (cocked) plunger could bring about movement of the firing pin just as if the mechanism were submerged in water. This is because surface tension in the small chamber could cause enough water to be retained therein to bring about this undesirable situation. Another disadvantage brought about by the requirement of the small chamber arises in sub-freezing environments. Specifically, water in the small chamber could quickly freeze due to its small volume. If this occurs, the mechanism will not function.

SUMMARY OF THE INVENTION

Accordingly, it is an object of the present invention to provide a mechanical actuator that is air-safed.

Another object of the present invention is to provide an air-safed mechanical actuator that can be used to bring about actuating movement only when submerged in an incompressible fluid.

Still another object of the present invention is to provide an air-safed mechanical actuator that operates reliably even in sub-freezing temperatures.

Other objects and advantages of the present invention will become more obvious hereinafter in the specification and drawings.

In accordance with the present invention, a mechanical device for generating actuating movement has a housing defining a first bore and a second bore contiguous with one another. The second bore can have a smaller diameter than the first bore. The housing also defines at least one radial port allowing an environment about the housing to communicate with the first bore. A first piston is slidably mounted in the first bore. A second piston is slidably mounted in the second bore and is positioned so that it is flush with the first bore. A spring, coupled to the first piston, is capable of an at-rest state in which the first piston is positioned in the first bore to seal off the radial port(s) while being spaced apart from the second piston. The spring is also capable of a compressed state in which the first piston is positioned such that the radial port(s) communicate with the first bore between the first piston and the second piston. When the housing is submerged in an incompressible fluid and the spring is in its compressed state, the radial port(s) admit fluid into the first bore. Then, when the spring is released from its compressed state and allowed to transition to its at-rest state, the first piston moves to seal off the radial port(s) and subsequently pressurize the fluid in the first bore between the first piston and the second piston. The pressurized fluid drives the second piston along the second bore to create the actuating movement.

DETAILED DESCRIPTION OF THE INVENTION

Figure 1:
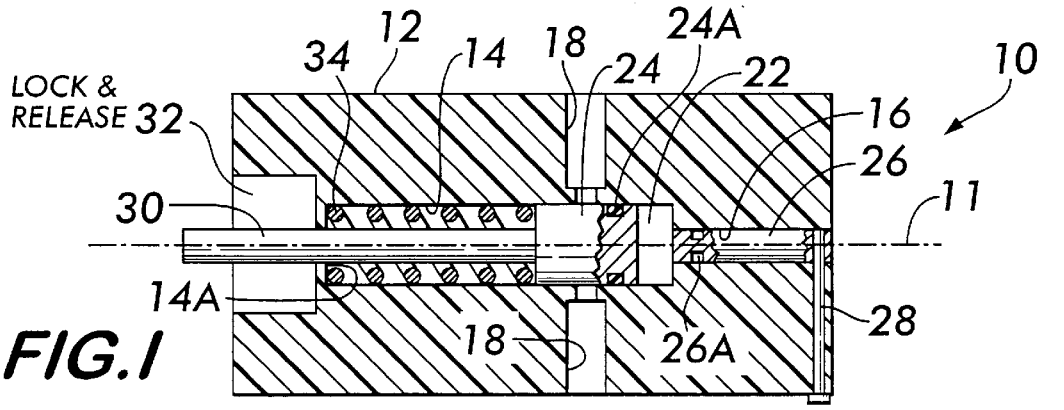
FIG. 1 is a side sectional view of an embodiment of the mechanical actuator of the present invention in its at-rest state.

Referring now to the drawings, FIGS. 1–4 depict the mechanical actuator of the present invention in its various stages of operation. Accordingly, the reference numerals will be the same for the common elements in each of the views. The mechanical actuator, referenced generally by numeral 10, can be used as a fuze's safety component but can also be used in any device requiring actuator movement only when submerged in an incompressible fluid. By way of example, mechanical actuator 10 is illustrated and will be described for use in harsh environmental conditions where sub-freezing air (e.g., on the order of 0° F. or less) and seawater (e.g., on the order of 27–29° F.) temperatures are expected. Note that the freezing temperature of seawater is generally less than 32° F. and can be considerably lower depending on salinity. However, it is to be understood that the present invention is not limited to use in such harsh environmental conditions.

The pre-use or at-rest state of mechanical actuator 10 illustrated in FIG. 1 will be referred to first to describe the component parts of actuator 10. A rigid housing 12 defines a first bore 14 and a second bore 16 therein. Bores 14 and 16 are adjoined and can be coaxially-aligned with one another along longitudinal axis 11 as in the illustrated embodiment. However, bores 14 and 16 could also be offset slightly with respect to their longitudinal axis. In the illustrated embodiment, the diameter of bore 14 is larger than that of bore 16 such that the cross-sectional area of bore 14 is at least several times that of bore 16. Also defined in housing 12 are one or more ports 18 linking the exterior of housing 12 with bore 14. Typically, ports 18 extend radially outward from bore 14 about the circumference of housing 12.

Disposed within bore 14 is a piston 24 mounted for sealed but sliding engagement in bore 14 in any of the conventional ways known in the art. For example, a ring seal (not shown for sake of clarity) can be retained in a circumferential notch 24A of piston 24. In the at-rest position, piston 24 is positioned such that ports 18 are sealed with respect to bore 14 and a chamber 22 is defined in bore 14 between piston 24 and the start of bore 16. The sealing of chamber 22 from ports 18 is insured by notch 24A (holding a ring seal) being positioned between ports 18 and the end of piston 24 facing chamber 22. The reasons for sealing off ports 18 from chamber 22 in this at-rest position will be explained in detail below.

Disposed in bore 16 is another piston 26 mounted for sealed but sliding engagement in bore 16. Accordingly, a ring seal (not shown for sake of clarity) can be retained in a circumferential notch 26A of piston 24. Note that the ring seal in notch 26A completes the sealing of chamber 22 between pistons 24 and 26. In the at-rest position, piston 26 is positioned so that it is flush with bore 14 for reasons that will be explained in detail below. Retention of piston 26 in the at-rest position can be passive (i.e., by means of the sealing strength of the ring seal in notch 26A) or can be active as illustrated. More specifically, the at-rest position of piston 26 can be maintained by providing a shear pin 28 coupling piston 26 to housing 12. In the illustrated example, shear pin 28 is inserted through housing 12 for ease of assembly. Other types of positioners (e.g., spring) can be used as long as they fail at the appropriate time as will be explained further below.

Coupled to or integral with (as shown) piston 24 is a piston rod 30 that extends back through bore 14 and, typically, out of housing 12. A lock and release mechanism 32 positioned in (as shown) or out of housing 12 is provided for engaging or disengaging from piston rod 30. Lock and release mechanism 32 is a mechanical device such as a ball lock type device. One suitable lock and release mechanism is disclosed in the afore-mentioned co-pending patent application entitled "LOCK AND RELEASE MECHANISM" U.S. patent application Ser. No. 09/211,002, the contents of which are hereby incorporated by reference.

In order to mechanically load piston 24, a spring 34 is provided in bore 14 about piston rod 30. Specifically, spring 34 is captured between piston 24 and the terminal end 14A of bore 14. To position piston 24 in its at-rest position, lock and release mechanism 32 can be disengaged from piston rod 30 and spring 24 can be selected to have an at-rest or maximum travel state that properly positions piston 24 as described above.

Figure 2:
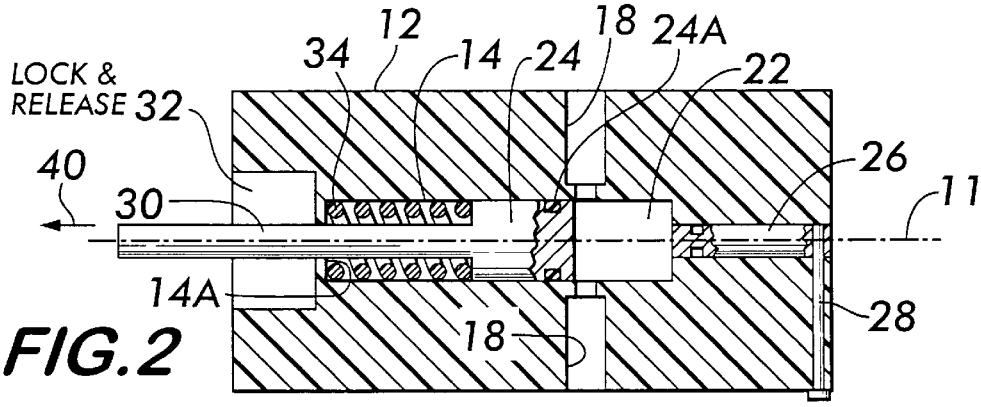
FIG. 2 is a side sectional view of the actuator in its readied state.

Operation of mechanical actuator 10 will now be explained beginning with the at-rest position illustrated in FIG. 1. Typically, actuator 10 is assembled and stored as in FIG. 1. To ready actuator 10, piston rod 30 is extracted from housing 12 in the direction of arrow 40 as depicted in FIG. 2 to draw piston along bore 14 and compress spring 34. The length of bore 14 and configuration of spring 34 are designed to allow piston 24 to clear ports 18. That is, chamber 22 is essentially expanded so that ports 18 can communicate therewith as shown in FIG. 2. In this way, a fluid environment (e.g., air or water) surrounding housing 12 is admitted into chamber 22 to fill same.

Figure 3:
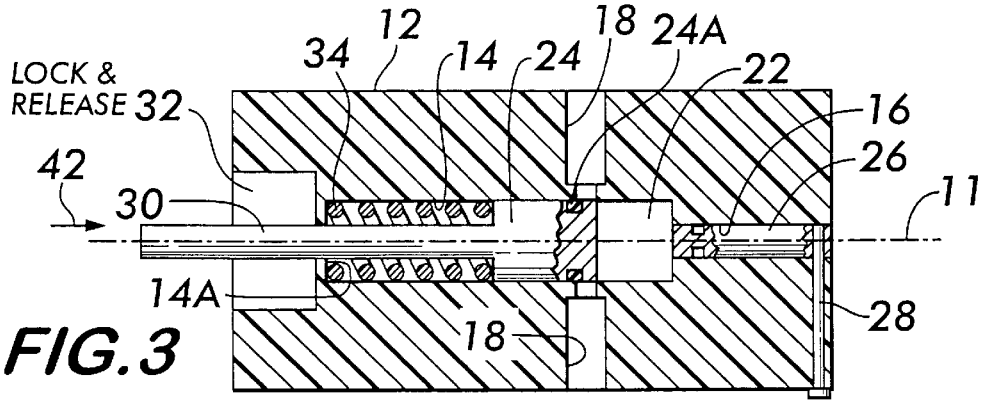
FIG. 3 is a side sectional view of the actuator in transition from its readied state to its at-rest state.
Figure 4:
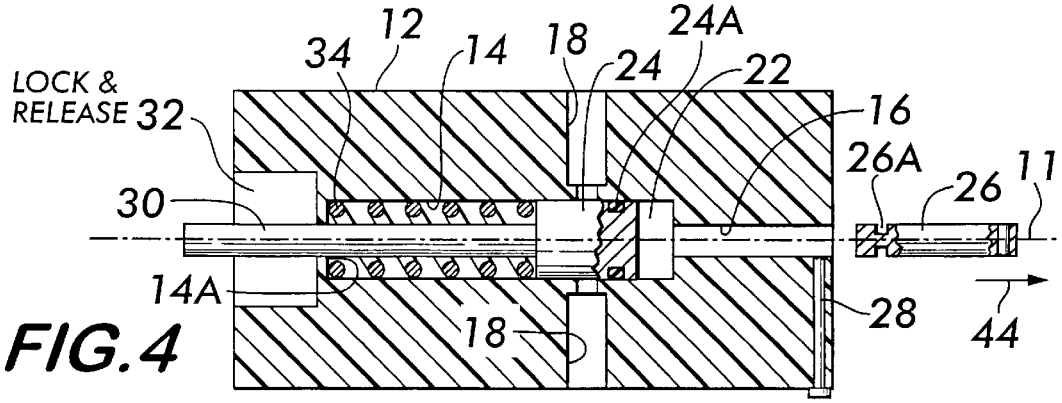
FIG. 4 is a side sectional view of the actuator after transition from its readied state to its at-rest state assuming the actuator was submerged in water or other incompressible fluid prior to being released from its readied state.

Assuming housing 12 is submerged in an incompressible fluid such as water, actuating movement is generated as follows. Lock and release mechanism 32 is disengaged from piston rod 30 with spring 34 compressed as in FIG. 2. Once this occurs, piston 24 begins to move in the direction of arrow 42 (as depicted in FIG. 3) under the force of spring 34 which is transitioning to its at-rest state. After piston 24 has again sealed off ports 18 as in FIG. 3, the incompressible fluid in chamber 22 is pressurized. The pressure in chamber 22 builds against piston 26 until shear pin 28 fails. At this point, as illustrated in FIG. 4, piston 26 is driven along bore 16 in the direction of arrow 44. The movement of piston 26 can be used, for example, to trigger a fuze's firing mechanism.

The technical constraint for preventing entrapment of air bubbles in chamber 22 (when housing 12 is submerged in water) is defined in terms of an L/D ratio where L is the length of chamber 22 in the ready position (FIG. 2) and D is the diameter of piston 24. If the L/D ratio is large, e.g., one or greater, there is a greater chance of entrapping air bubbles in chamber 22 than if the L/D ratio is less than one. The L/D ratio used in successful tests of the present invention was approximately 0.375.

If housing 12 is surrounded by a compressible fluid (e.g., air) while in its ready state shown in FIG. 2, piston 26 will not be driven along bore 16 when lock and release mechanism 32 is disengaged from piston rod 30. This is because air is compressible and when piston 24 has fully transitioned from the ready position (FIG. 2) to the at-rest position (FIG. 4), the volume of chamber 22 is sufficiently large that the build-up of pressure is insufficient to break shear pin 28.

The advantages of the present invention are numerous. The actuator is fully mechanical and therefore presents no safety concerns for the assembly, storage and usage thereof. For the same reason, the present invention can be used as an actuator in many applications where explosive materials are not allowed or preferred. In addition, the present invention requires two conditions for operation, i.e., cocking of the actuator to the ready state and submergence in an incompressible fluid. Thus, if the actuator is inadvertently submerged in water before the actuator is readied, chamber 22 is fully sealed against leakage from the outside environment. The flush positioning of piston 26 at bore 14 means that chamber 22 is fully constrained to be within the larger diameter bore 14. This insures that chamber 22 will fill fully with water when housing 12 is submerged. There is no small chamber defined in bore 16 that could inadvertently retain water which might get pressurized sufficiently to cause actuating movement of piston 26 or retain an air bubble which might prevent actuating movement of piston 26 when actuator 10 is submerged in water.

As illustrated, mechanical actuator 10 is constructed for reliable use in harsh environmental conditions where the air is 0° F. or less while the water (e.g., seawater) temperature is at or close to its freezing point, i.e., typically on the order of 27–29° F. In order to prevent the formation of ice in bore 14 or on piston 24, materials used for at least housing 12 and piston 24 should have a low thermal conductivity. Piston 26 and piston rod 30 could also be made of the same material as illustrated. For purpose of the present invention, low thermal conductivity is defined as a material that does not support the formation of ice thereon (at least prior to and during disengagement of lock and release mechanism 32) when cooled to a sub-freezing temperature prior to submergence in freezing seawater. Suitable materials are a variety of plastics such as acetal which is a thermoplastic material with inherent lubricating qualities. Acetal is manufactured by DuPont de Nemours, E.I. and Co. under the trademark Delrin. Materials such as these possess thermal conductivities that are approximately 100 times less than the thermal conductivities of most metals which are susceptible to having ice form thereon when subjected to the conditions described above.

Although the invention has been described relative to a specific embodiment thereof, there are numerous variations and modifications that will be readily apparent to those skilled in the art in light of the above teachings. For example, as described above, bores 14 and 16 can be offset from one another with respect to their longitudinal axes. Bores 14 and 16 could also be angularly disposed with respect to one another. In some applications, bores 14 and 16 could have the same diameter. It is therefore to be understood that, within the scope of the appended claims, the invention may be practiced other than as specifically described.

What is claimed as new and desired to be secured by Letters Patent of the United States is:

1. A mechanical device for generating actuating movement, comprising:

a housing defining a first bore and a second bore contiguous and coaxial with said first bore, said second bore having a smaller diameter than said first bore, said housing further defining at least one radial port allowing an environment about said housing to communicate with said first bore;

a first piston slidably mounted in said first bore;

a second piston slidably mounted in said second bore and positioned flush with said first bore; and a spring coupled to said first piston and capable of an at-rest state in which said first piston is positioned in said first bore to seal off said at least one radial port while being spaced apart from said second piston, said spring further capable of a compressed state in which said first piston is positioned such that said at least one radial port communicates with said first bore between said first piston and said second piston wherein, when said housing is submerged in an incompressible fluid and said spring is in said compressed state, said at least one radial port admits said fluid into said first bore so that when said spring is released from said compressed state and allowed to transition to said at-rest state, said first piston moves in said first bore to seal off said at least one radial port and subsequently pressurize said fluid in said first bore between said first piston and said second piston to drive said second piston along said second bore as said actuating movement.

2. A mechanical device as in claim 1 further comprising a positioner coupled to said second piston for restraining said second piston flush with said first bore until said first piston moves in said first bore to seal off said at least one radial port and subsequently pressurize said fluid in said first bore between said first piston and said second piston.

3. A mechanical device as in claim 2 wherein said positioner is a shear pin passing at least partly into said second piston and at least partly into said housing wherein said shear pin is selected to fail when said fluid in said first bore between said first piston and said second piston is pressurized by movement of said first piston as said spring transitions to said at-rest state.

4. A mechanical device as in claim 1 wherein said fluid is seawater having a temperature at or below its freezing point, and wherein at least said housing and said first piston are made from a material having a thermal conductivity defined as not supportive of the formation of ice thereon when cooled to a temperature less than said seawater prior to submergence therein.

5. A mechanical device as in claim 4 wherein said second piston is made from said material.

6. A mechanical device as in claim 1 wherein said at least one radial port comprises a plurality of radial ports disposed circumferentially about said housing.

7. A mechanical device for generating actuating movement, comprising:

a housing defining a first bore and a second bore contiguous with said first bore, said housing further defining at least one radial port allowing an environment about said housing to communicate with said first bore;

a first piston slidably mounted in said first bore;

a second piston slidably mounted in said second bore and positioned flush with said first bore; and means coupled to said first piston for positioning said first piston in a first position defined by said first piston sealing off said at least one radial port while being spaced apart from said second piston wherein a chamber in said first bore is defined between said first piston and said second piston, said means supporting on-demand movement of said first piston to a second position wherein said chamber expands so that said at least one radial port is in communication with said chamber and wherein an incompressible fluid can fill said chamber when said housing is submerged therein, said means further driving said first piston from said second position towards said first position wherein, after said first piston seals off said at least one radial port, said first piston pressurizes said fluid in said chamber to drive said second piston along said second bore as said actuating movement.

8. A mechanical device as in claim 7 further comprising a positioner coupled to said second piston for restraining said second piston flush with said first bore until said first piston moves in said first bore to seal off said at least one radial port and subsequently pressurize said fluid in said chamber.

9. A mechanical device as in claim 8 wherein said positioner is a shear pin passing at least partly into said second piston and at least partly into said housing wherein said shear pin is selected to fail when said fluid in said chamber is pressurized by movement of said first piston towards said first position.

10. A mechanical device as in claim 7 wherein said fluid is seawater having a temperature at or below its freezing point, and wherein at least said housing and said first piston are made from a material having a thermal conductivity defined as not supportive of the formation of ice thereon when cooled to a temperature less than said seawater prior to submergence therein.

11. A mechanical device as in claim 10 wherein said second piston is made from said material.

12. A mechanical device as in claim 7 wherein said at least one radial port comprises a plurality of radial ports disposed circumferentially about said housing.

13. A mechanical device as in claim 7 wherein said second bore has a smaller diameter than said first bore.

14. A mechanical device as in claim 7 wherein said first bore and said second are coaxial.

15. A mechanical device as in claim 7 wherein said first piston has a diameter D and an axial length L of said chamber is defined when said first piston is in said second position such that L/D is less than one.

16. A mechanical device for generating actuating movement when submerged in seawater having a temperature at or below its freezing point, comprising:

a housing made from a rigid material having a thermal conductivity defined as not supportive of the formation of ice thereon when cooled to a temperature less than said seawater prior to submergence therein, said housing defining a first bore and a second bore contiguous with said first bore, said housing further defining a least one radial port allowing an environment about said housing to communicate with said first bore;

a first piston made from said rigid material and slidably mounted in said first bore;

a second piston slidably mounted in said second bore and positioned flush with said first bore; and a mechanical loading mechanism coupled to said first piston and capable of an at-rest state that positions said first piston in a first position defined by said first piston sealing off said at least one radial port while being spaced apart from said second piston wherein a chamber in said first bore is defined between said first piston and said second piston, said mechanical loading mechanism further capable of a cocked state that positions said first piston in a second position wherein said chamber is expanded so that said at least one radial port is in communication with said chamber and so that seawater can fill said chamber when said housing is submerged therein, said mechanical loading mechanism capable of driving said first piston from said second position towards said first position when said mechanical loading mechanism is released from said cocked state wherein, after said first piston seals off said at least one radial port, said first piston pressurizes said fluid in said chamber to drive said second piston along said second bore as said actuating movement.

17. A mechanical device as in claim 16 further comprising a positioner coupled to said second piston for restraining said second piston flush with said first bore until said first piston moves in said first bore to seal off said at least one radial port and subsequently pressurize said fluid in said chamber.

18. A mechanical device as in claim 17 wherein said positioner is a shear pin passing at least partly into said second piston and at least partly into said housing wherein said shear pin is selected to fail when said fluid in said chamber is pressurized by movement of said first piston towards said first position.

19. A mechanical device as in claim 16 wherein said second piston is made from said rigid material.

20. A mechanical device as in claim 16 wherein said at least one radial port comprises a plurality of radial ports disposed circumferentially about said housing.

21. A mechanical device as in claim 16 wherein said second bore has a smaller diameter than said first bore.

22. A mechanical device as in claim 16 wherein said first bore and said second are coaxial.

23. A mechanical device as in claim 16 wherein said first piston has a diameter D and an axial length L of said chamber is defined when said first piston is in said second position such that L/D is less than one.

* * * * *